US010194247B2

(12) United States Patent
Epping

(10) Patent No.: US 10,194,247 B2
(45) Date of Patent: Jan. 29, 2019

(54) ELECTRODYNAMIC SOUND TRANSDUCER

(71) Applicant: Sennheiser electronic GmbH & Co. KG, Wedemark (DE)

(72) Inventor: Heinz Epping, Hildesheim (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/456,216

(22) Filed: Mar. 10, 2017

(65) Prior Publication Data

US 2017/0188156 A1 Jun. 29, 2017

Related U.S. Application Data

(63) Continuation of application No. PCT/EP2015/071411, filed on Sep. 18, 2015.

(51) Int. Cl.

| | |
|---|---|
| ***H04R 9/02*** | (2006.01) |
| ***H04R 1/28*** | (2006.01) |
| ***H04R 7/12*** | (2006.01) |
| *H04R 9/04* | (2006.01) |
| *H04R 9/06* | (2006.01) |
| *H04R 9/08* | (2006.01) |

(52) U.S. Cl.

CPC ..... *H04R 9/025* (2013.01); *H04R 1/2811* (2013.01); *H04R 7/127* (2013.01); *H04R 9/047* (2013.01); *H04R 9/06* (2013.01); *H04R 9/08* (2013.01)

(58) Field of Classification Search

CPC ..... H04R 1/2811; H04R 7/127; H04R 9/025; H04R 9/047; H04R 9/06; H04R 9/08

See application file for complete search history.

(56) References Cited

U.S. PATENT DOCUMENTS

| | | | | |
|---|---|---|---|---|
| 6,636,612 | B1 | 10/2003 | North et al. | |
| 2002/0057819 | A1 * | 5/2002 | Czerwinski | H04R 1/30 381/398 |
| 2004/0070294 | A1 | 4/2004 | Hanada | |
| 2007/0206830 | A1 * | 9/2007 | Usuki | H04R 9/025 381/412 |

FOREIGN PATENT DOCUMENTS

| | | | |
|---|---|---|---|
| DE | 20 2009 011485 | U1 | 1/2010 |
| EP | 1434463 | A2 | 6/2004 |
| EP | 1434463 | A3 | 11/2008 |
| GB | 311486 | | 5/1929 |

(Continued)

OTHER PUBLICATIONS

Written Opinion for PCT/EP2015/071411 dated Dec. 11, 2015, 6 pages (non-English).

(Continued)

*Primary Examiner* — Tuan D Nguyen

(74) *Attorney, Agent, or Firm* — Kilpatrick Townsend & Stockton LLP

(57) ABSTRACT

There is provided an electrodynamic sound transducer having a diaphragm capable of vibrating, a vibrating coil coupled to the diaphragm, and a magnet system. The magnet system has a first and a second magnet ring, which are arranged above and below the diaphragm and are radially magnetized. The vibrating coil is arranged between the first and second magnet rings.

9 Claims, 8 Drawing Sheets

(56) References Cited

FOREIGN PATENT DOCUMENTS

| | | | |
|---|---|---|---|
| JP | 59216398 | A | 12/1984 |
| WO | 2016/046075 | A1 | 3/2016 |

OTHER PUBLICATIONS

First Notice Informing the Applicant of the Communication to the International Application (To Designated Offices Which Apply to the 30 month time Limit Under Article 22(1) for PCT/EP2015/071411 dated Sep. 18, 2015, 1 page.
Second and Supplementary Notice Informing the Applicant of the Communication to the International Application (To Designated Offices Which Apply to the 30 month time Limit Under Article 22(1) for PCT/EP2015/071411 dated Jan. 26, 2017, 1 page.
International Search Report for PCT/EP2015/071411 dated Dec. 11, 2015, 7 pages (non-English).
Notification of Receipt of Record Copy for PCT/EP2015/071411 dated Sep. 29, 2015, 1 page.
Notification Concerning Availability of the Publication of the International Application for for PCT/EP2015/071411 dated Mar. 31, 2016, 1 page.

* cited by examiner

ELECTRODYNAMIC SOUND TRANSDUCER

CROSS-REFERENCE TO RELATED APPLICATIONS

The present application is a continuation of PCT Application No. PCT/EP2015/071411, filed Sep. 18, 2015, which claims priority to German Application No. 102014218986.1, filed Sep. 22, 2014, the disclosures of which are hereby incorporated by reference in their entirety for all purposes.

BACKGROUND

Electrodynamic sound transducers have long been known and have a diaphragm capable of vibrating, a vibrating coil coupled to the diaphragm and a magnet system cooperating with the vibrating coil. In that arrangement, the diaphragm and the vibrating coil form the element, which is capable of vibrating of the electrodynamic sound transducer.

In a conventional electrodynamic sound transducer the vibrating mass consisting of the diaphragm and the vibrating coil can prove to be a disadvantage.

On the German patent application from which priority is claimed the German Patent and Trade Mark Office searched the following documents: U.S. Pat. No. 6,636,612 B1 and EP 1 434 463 A2.

BRIEF SUMMARY

Aspects of the present invention concern an electrodynamic sound transducer.

Thus, an object of the present invention is to provide an electrodynamic sound transducer having a reduced vibrating mass.

That object can be attained by an electrodynamic sound transducer as described herein.

Thus, there is provided an electrodynamic sound transducer having a diaphragm capable of vibrating, and a vibrating coil coupled to the diaphragm and a magnet system. The magnet system has a first and a second magnet ring which are arranged above and below the diaphragm and are radially magnetized. The vibrating coil is arranged between the first and second magnet rings. The first magnet ring has an end having a projection, for example, in the form of a point or a round portion, which extends towards the diaphragm. In that way, the cross-section of the first and second magnet rings is adapted to the configuration or curvature of the diaphragm.

According to an aspect of the present invention, the magnetization direction of the first and second magnet rings is in the same direction.

According to a further aspect of the invention, the first magnet ring is arranged on a resonator above the diaphragm, and the second magnet ring is arranged on a chassis below the diaphragm.

In that way, the flux density and thus also the magnetic field can be increased.

According to a further aspect of the present invention, the point of the first magnet ring is adapted to the configuration of a coil seat of the diaphragm.

The electrodynamic sound transducer, according to aspects of the invention, has two radially magnetized magnet rings, between which is disposed the diaphragm having the vibrating coil. Optionally, the magnetization direction of the two rings can be in the same direction. Optionally, one of the rings can be fixed to a resonator above the coil. Optionally, the second ring can be fixed to a chassis below the coil. Optionally, the resonator arranged above the diaphragm can have a recess adapted to the shape of the diaphragm (in particular in the middle region, that is to say the dome).

With the electrodynamic sound transducer, according to aspects of the invention, a mechanically insensitive transducer system with a small vibrating mass is made possible. That makes it possible to achieve an improved transient performance on the part of the electrodynamic sound transducer. With the electrodynamic sound transducer according to aspects of the invention, it is possible to enjoy similar acoustic properties as in the case of a ribbon transducer, but with a mechanically robust structure. The diaphragm according to aspects of the invention, can be glued at the entire edge so that the front and rear sides of the transducer are sealed off relative to each other. It is also possible to implement a directional microphone with the electrodynamic sound transducer according to aspects of the invention.

Optionally, the vibrating coil has a plurality of turns which are mounted in mutually juxtaposed relationship on the diaphragm. The height of the coil can then determined based on the coil wire diameter.

Optionally, the conductor tracks can be produced by vapor deposition, printing or in the form of circuit board material.

Advantages and embodiments, by way of example of the invention, are described in greater detail hereinafter with reference to the drawings.

DETAILED DESCRIPTION

Figure 1:
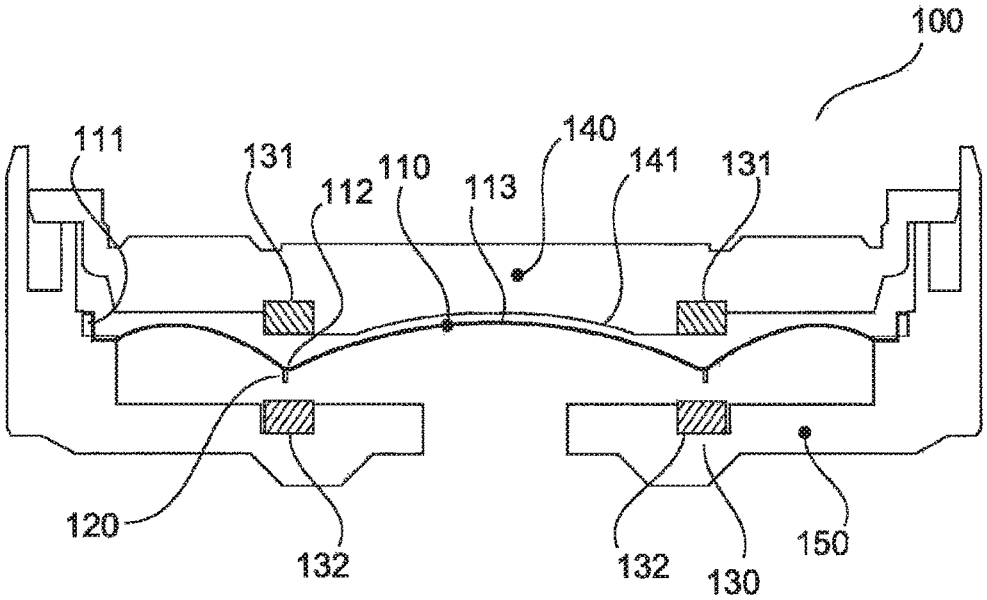
FIG. 1 shows a diagrammatic sectional view of an electrodynamic sound transducer, according to a first embodiment.

FIG. 1 shows a diagrammatic sectional view of an electrodynamic sound transducer, according to certain embodiments. The sound transducer 100 has a diaphragm 110, a magnet system 130, a vibrating coil 120, optionally a resonator 140 and a chassis 150.

The diaphragm 110 can be fixed to the chassis 150 at the outer edge 111 of the diaphragm, for example by gluing. The vibrating coil 120 can be fixed to a coil seat 112 of the diaphragm. Optionally the diaphragm 110 can have a dome 113.

The magnet system 130 has a first and a second magnet ring 131, 132. The first magnet ring 131 can be fixed to the resonator 140, that is to say therefore above the diaphragm. The second magnet ring 132 can be fixed below the diaphragm, for example to the chassis 150.

The first and second magnet rings 131, 132 are radially magnetized. Optionally, the magnetization direction of the first and second magnet rings 131, 132 is in the same direction.

The coil has at least one turn. Optionally, a plurality of turns can be arranged in mutually juxtaposed relationship so that the height of the coil corresponds to the coil wire diameter. It should be noted however that other geometrical arrangements of the coil 120 are also possible to achieve a compromise between small mass and long conductor length, in which respect a large quantity of conductor affords greater sensitivity. Optionally, the height of the coil is limited so that the coil is rather of a flat configuration.

Figure 2:
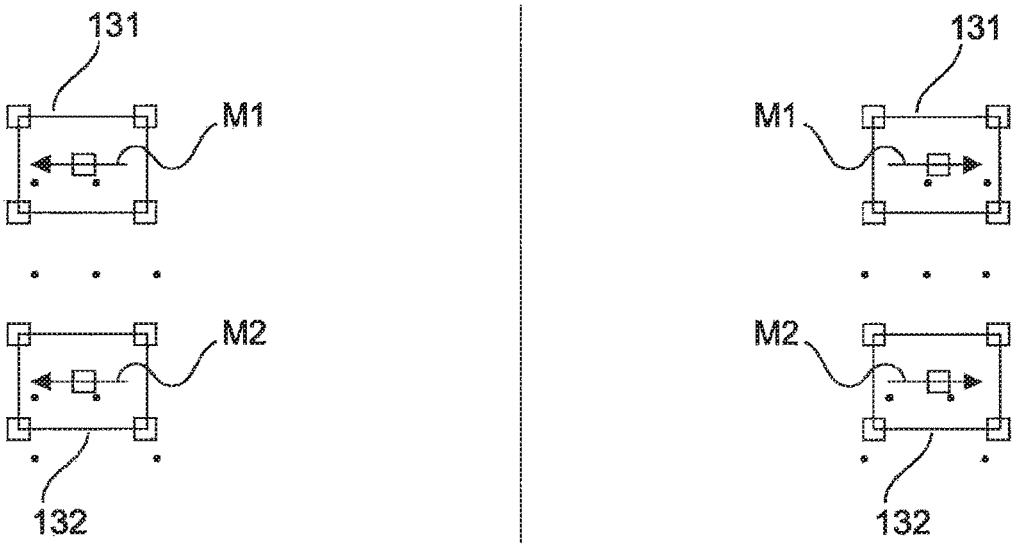
FIG. 2 shows a diagrammatic view of the magnet system, according to the first embodiment.

FIG. 2 shows a diagrammatic sectional view of the first and second magnet rings. The two magnet rings are magnetized radially. The first ring 131 has a magnetization direction M1 from the inside outwardly and the second ring 132 has a second magnetization direction M2 also from the inside outwardly. In this case, the first magnetization direction M1 corresponds to the second magnetization direction M2, that is to say the first and second rings 131, 132 are radially magnetized in the same direction.

Figure 3A:
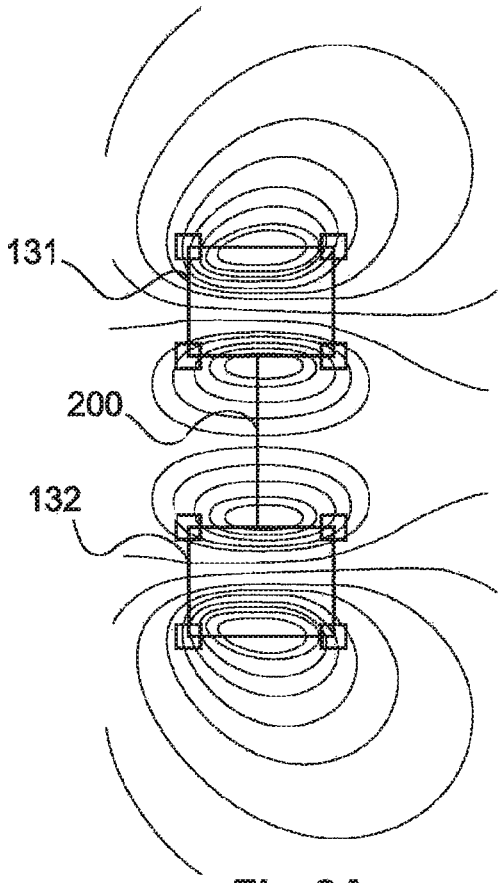
FIGS. 3A and 3B each show a diagrammatic view of the magnetic lines for an electrodynamic sound transducer, according to a first embodiment.

FIG. 3A shows a diagrammatic view of the magnetic lines for an electrodynamic sound transducer, according to a first embodiment. The flux lines of the magnetic field are shown in FIG. 3A. In this case the field lines extend perpendicularly to the direction of movement of the coil 120 and more specifically almost in the entire region between the magnet rings 131, 132.

Figure 3B:
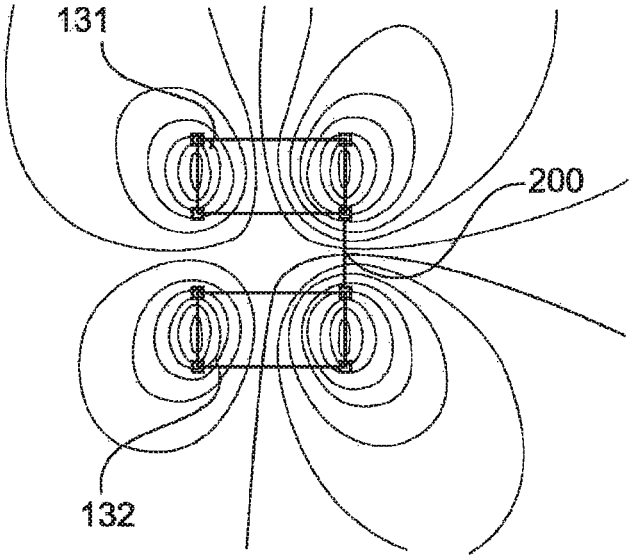

FIG. 3B shows the field lines in accordance with the state of the art in which the first and second magnet rings 131, 132 are magnetized axially in opposite directions. In this case, the useable flux density region is then limited to the region of the outside diameter.

Figure 4:
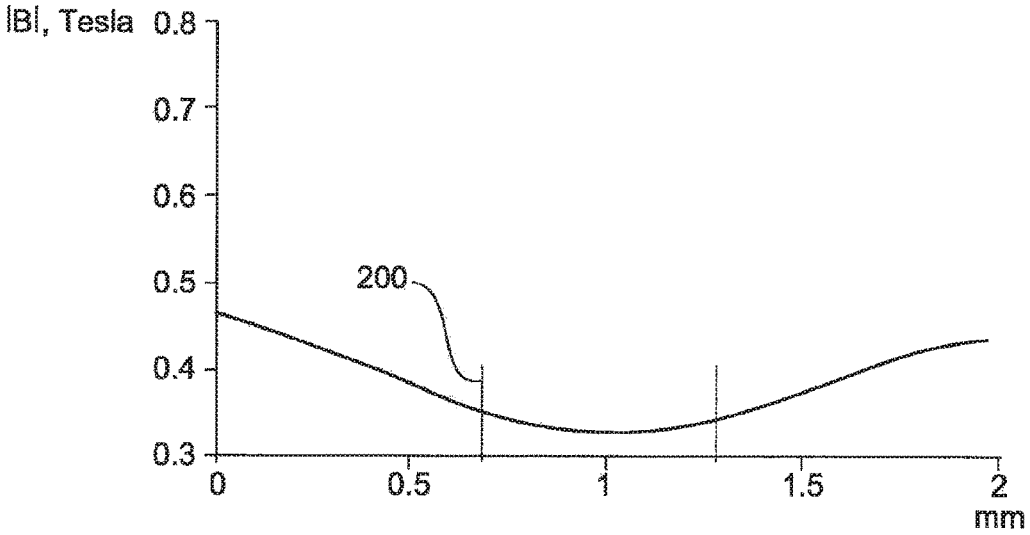
FIG. 4 shows a graph to illustrate the flux density between the two rings of the magnet system, according to the first embodiment.

FIG. 4 shows the pattern of the flux density over the line 200 in FIG. 3A. FIG. 4 characterizes in particular the region which represents the deflection region of ±0.3 mm. According to aspects of the invention, the deflection of the coil is mechanically limited by the spacing between the diaphragm and the resonator and between the diaphragm and the chassis. According to aspects of the invention, therefore the vibrating coil moves substantially in a linear region of the flux density characteristic curve. According to aspects of the invention, the coil can be disposed centrally between the first and second magnet rings 131, 132.

Figure 5A:
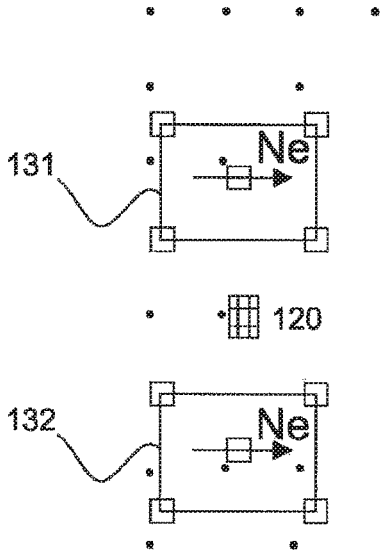
FIGS. 5A and 5B each show a diagrammatic sectional view of an electrodynamic sound transducer, according to the first embodiment.
Figure 5B:
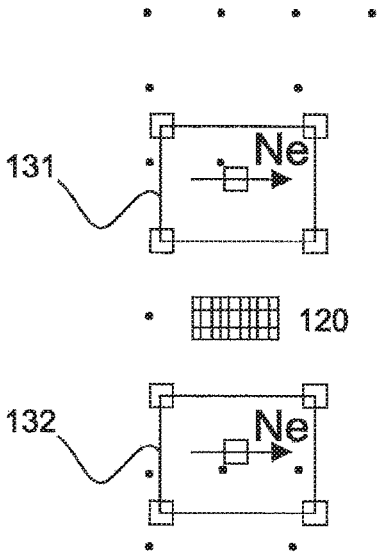

FIGS. 5A and 5B show an arrangement of the vibrating coil centrally between the first and second rings 131, 132.

FIG. 5A shows a narrow vibrating coil 120 while FIG. 5B shows a wider vibrating coil 120, between the first and second magnet rings 131, 132.

It will be seen from FIG. 3A that the flux lines are correctly oriented in the entire area between the rings. The coil can therefore operate in the entire width of the magnet rings.

Figure 6:
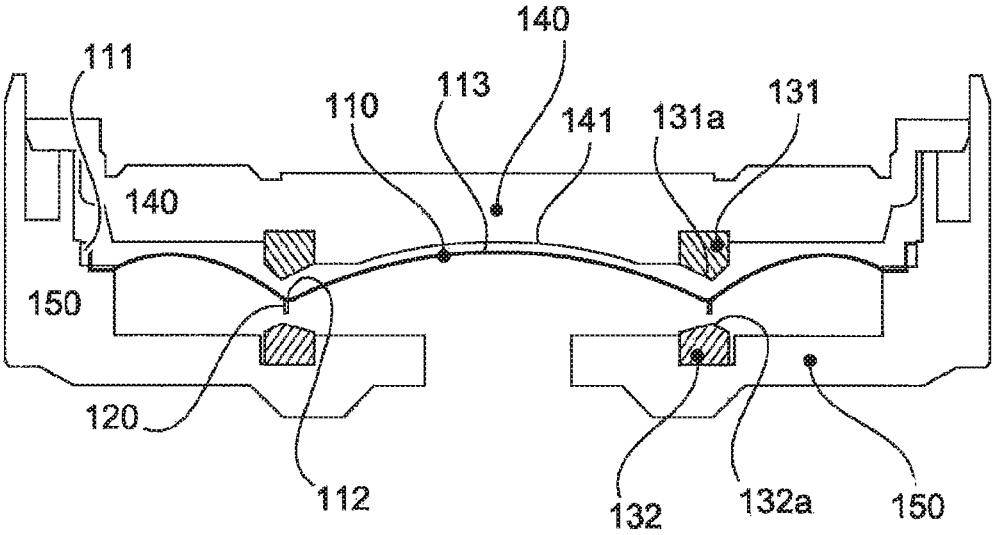
FIG. 6 shows a diagrammatic sectional view of an electrodynamic sound transducer, according to a second embodiment.

FIG. 6 shows a diagrammatic sectional view of an electrodynamic transducer, according to a second embodiment. The electrodynamic transducer according to the second embodiment is substantially based on the electrodynamic transducer according to the first embodiment. The electrodynamic transducer 100 thus has a diaphragm 110 having a coil seat 112, a vibrating coil 120, a magnet system 131 comprising a first and a second magnet ring 131, 132, a resonator 140 and a chassis 150. The electrodynamic sound transducer 100 according to the second embodiment differs from the electrodynamic sound transducer according to the first embodiment only by virtue of the configuration of the first and second magnet rings 131, 132. In this case the first magnet ring 131 has an end 131*a* extending towards the diaphragm 110. The first magnet ring in cross-section has a point 131*a* extending towards the diaphragm. The second magnet ring 132 has an end 132*a* extending towards the diaphragm 110. The second magnet ring 132 also optionally has—in cross-section—a point 132*a* which also extends towards the coil 120. The point 131*a* of the magnet ring 131 can be adapted to the configuration of the coil seat 112 of the diaphragm. The ends 131*a*, 132*a* can be of a round or pointed configuration.

The configuration of the ends 131*a*, 132*a* of the first and/or second magnet ring 131, 132 is adapted to the contour of the diaphragm 110 at that location (for example at the coil seat).

The ends 131*a* of the first magnet ring 131 are not flat but have for example a projection 131*a* (for example in the form of a point or a round portion) extending towards the diaphragm 110.

The ends 132*a* of the second magnet ring 132 can optionally also have a corresponding projection for reasons of symmetry.

Figure 7A:
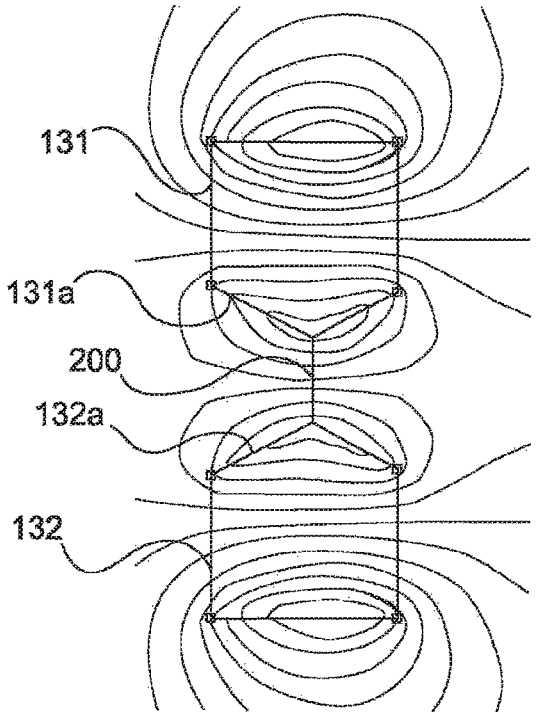
FIG. 7A shows a diagrammatic view of the flux line configuration in an electrodynamic sound transducer, according to a second embodiment.

FIG. 7A shows a cross-section through the first and second magnet rings 131, 132 and the pattern of the flux lines.

Figure 7B:
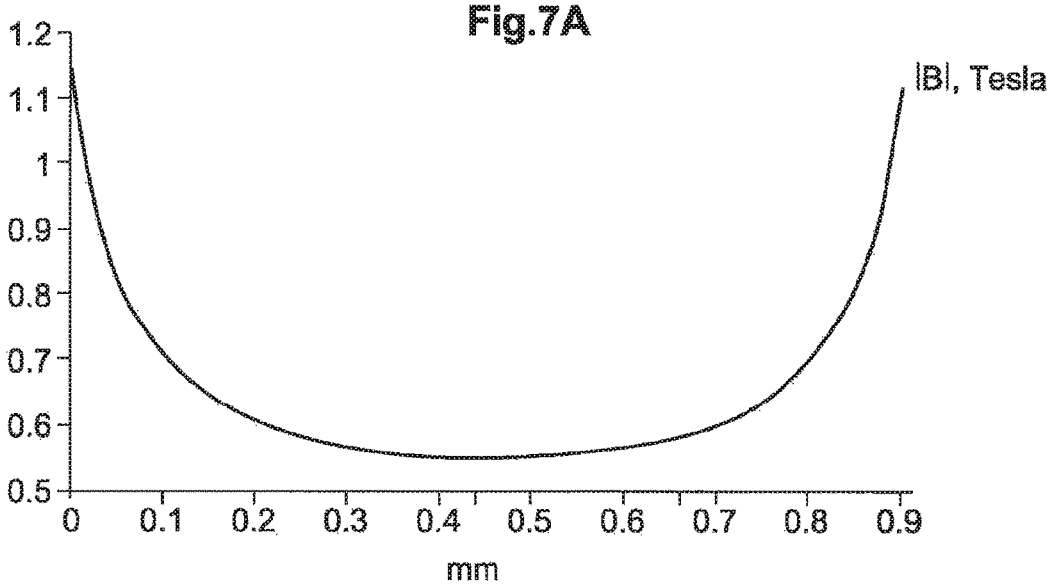
FIG. 7B shows the pattern of the field strength between two rings of the magnet system, according to the second embodiment.

FIG. 7B shows the pattern of the flux density over the line 200 which extends from the point 131*a* to the point 132*a*. By virtue of the change in the cross-sections of the first and second magnet rings 131, 132 (with the projections in the form of points or round portions) it is possible to increase the flux density and correspondingly influence the pattern of the flux density so that a strong magnetic field is achieved.

The maximum deflection of the diaphragm is not influenced by the change in the cross-section of the first and second diaphragm magnet rings.

Figure 8:
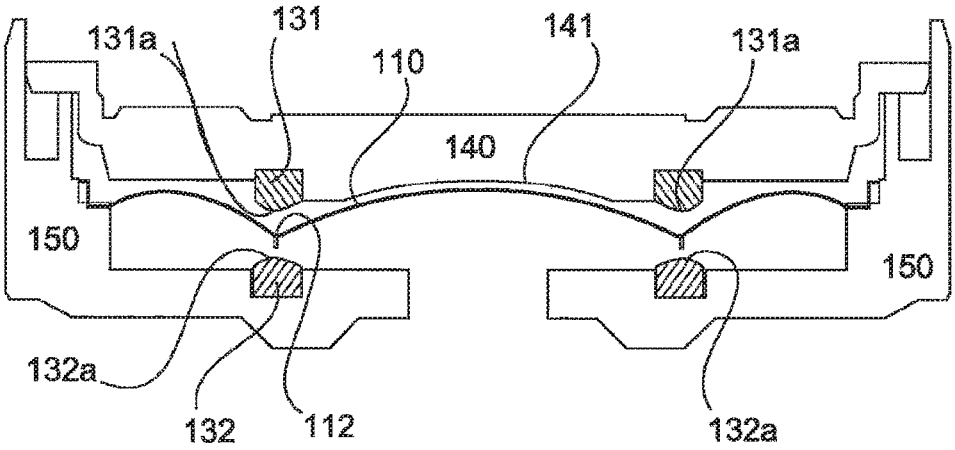
FIG. 8 shows a diagrammatic sectional view of an electrodynamic sound transducer, according to a third embodiment.

FIG. 8 shows a diagrammatic sectional view of an electrodynamic sound transducer according to a third embodiment. The electrodynamic sound transducer according to the third embodiment substantially corresponds to the electrodynamic sound transducer according to the second embodiment, but the cross-section of the first and second magnet rings 131, 132 is of a different configuration. While the second embodiment has a point the tips 131*a* and 132*a* are rounded off.

According to aspects of the invention, there is provided an electrodynamic sound transducer having a similar sensitivity as in the case of a ribbon microphone. The in part low sensitivity can be boosted for example by way of a transmitter or a low-noise circuit.

Figure 9:
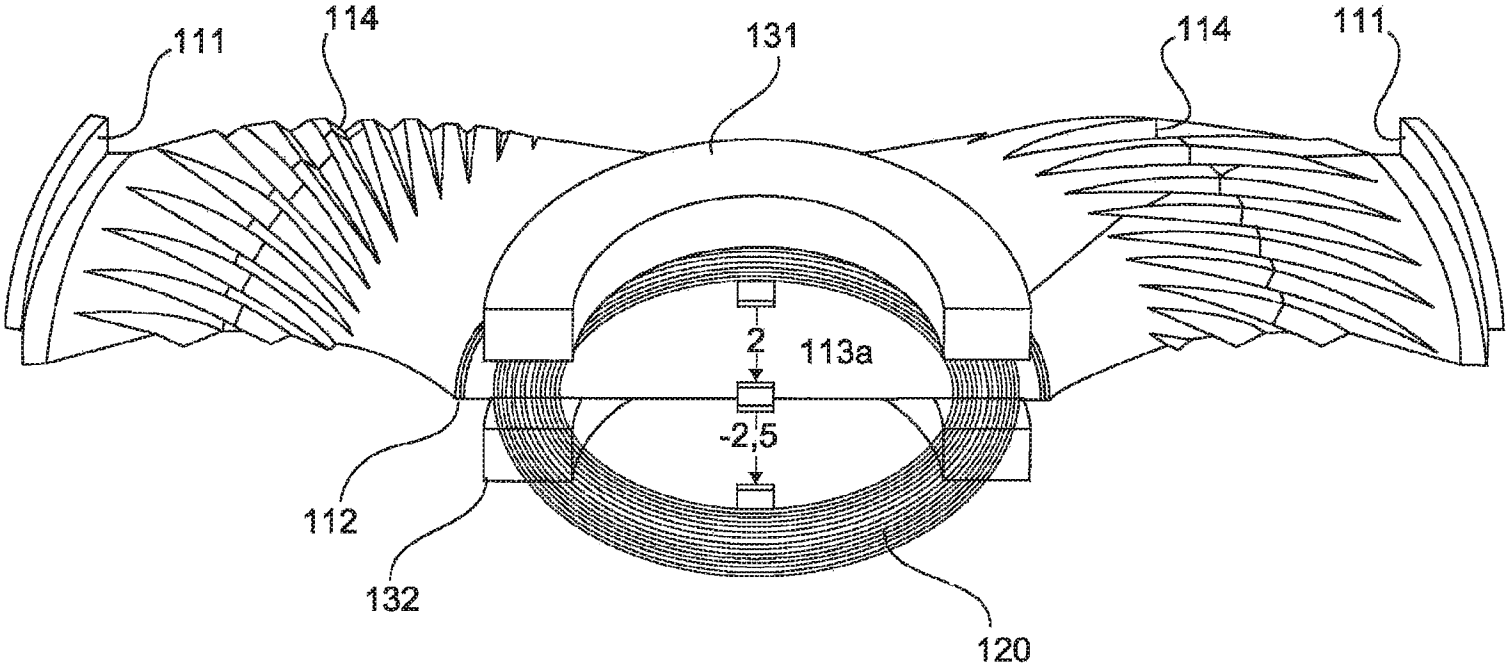
FIG. 9 shows a diagrammatic perspective view of an electrodynamic sound transducer, according to a fourth embodiment.

FIG. 9 shows a diagrammatic perspective sectional view of an electrodynamic transducer according to a fourth embodiment. The electrodynamic sound transducer according to the fourth embodiment can be based on the electrodynamic sound transducer according to the first embodiment, but does not have a dome. Rather, the region which is encircled by the vibrating coil and the first and second magnet rings 131, 132 is flat. In addition, the vibrating coil 120, according to the fourth embodiment, can be produced from a plurality of turns placed in mutually juxtaposed relationship.

Figure 10:
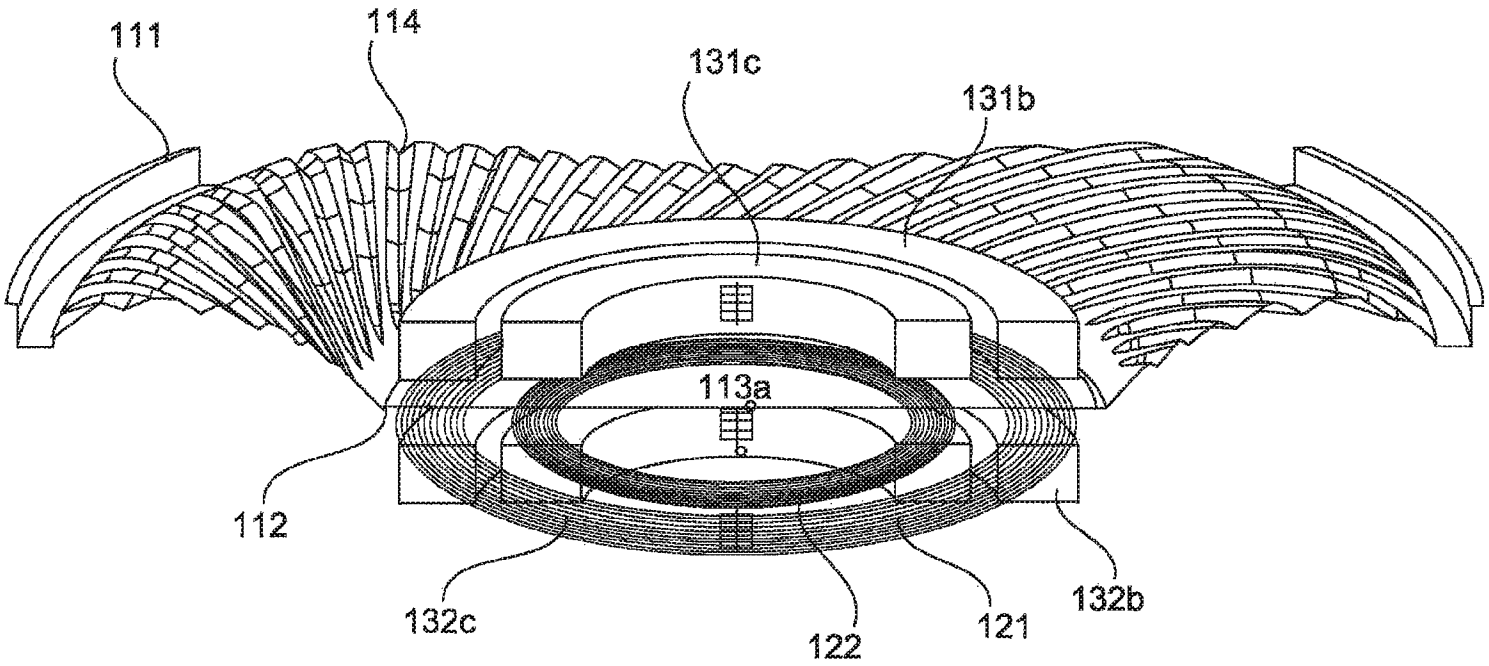
FIG. 10 shows a diagrammatic perspective view of an electrodynamic sound transducer, according to a fifth embodiment.

FIG. 10 shows a diagrammatic perspective sectional view of an electrodynamic sound transducer, according to a fifth embodiment. The electrodynamic sound transducer, according to the fifth embodiment, can be based on the electrodynamic sound transducer according to the fourth embodiment. While the electrodynamic sound transducer, according to fourth embodiment, only has a first and a second magnet ring 131, 132 the electrodynamic sound transducer, according to the fifth embodiment, has a pair of first and second magnet rings 131*b*, 131*c* and 132*b*, 132*c*. In addition the vibrating coil can be of a divided structure so that there can be provided a first portion 121 and a second portion 122. In this case, the first vibrating coil portion 121 can be disposed under the outer ring 131*b* and the second vibrating coil portion can be disposed under the inner magnet ring 131*c*.

The sound transducer, according to aspects of the invention, can be used in an earphone or in a microphone.

What is claimed is:

1. An electrodynamic sound transducer comprising:

a diaphragm capable of vibrating, a vibrating coil coupled to the diaphragm; and a magnet system having a first and a second magnet ring which are arranged above and below the diaphragm and are radially magnetized, wherein the vibrating coil is arranged between the first and second magnet rings, wherein the first magnet ring has an end having a projection, in particular a point or a round portion, which extends towards the vibrating coil coupled to the diaphragm and is adapted to a contour of the diaphragm at the vibrating coil in a region of the first and second magnet rings, and wherein a magnetization direction of the first and second magnet rings is in the same direction.

2. An electrodynamic sound transducer as set forth in claim 1 wherein the first magnet ring is arranged on a resonator above the diaphragm, and the second magnet ring is arranged on a chassis below the diaphragm.

3. An electrodynamic sound transducer as set forth in claim 1 wherein the second magnet ring has an end having a projection, in particular a point or a round portion, which extends towards the diaphragm.

4. An electrodynamic sound transducer as set forth in claim 3 wherein the projection, in particular the point or round portion, of the first magnet ring is adapted to a configuration of a coil seat of the diaphragm.

5. An earphone comprising:

an electrodynamic sound transducer as set forth in one of claims 1 and 2-4.

6. A microphone comprising: an electrodynamic sound transducer as set forth in one of claims 1 and 2 through 4.

7. An electrodynamic sound transducer as set forth in claim 1, wherein the second magnet ring has an end having a projection which extends towards the vibrating coil coupled to the diaphragm and is adapted to a contour of the diaphragm at the vibrating coil.

8. An electrodynamic sound transducer comprising:

a diaphragm capable of vibrating, a vibrating coil coupled to the diaphragm, and a magnet system having a first and a second magnet ring which are arranged above and below the diaphragm in a region of the vibrating coil, wherein the vibrating coil is arranged between the first and second magnet rings, wherein the first magnet ring has a cross-section which has a projection, in particular a point or a round portion, which extends towards the vibrating coil coupled to the diaphragm and is adapted to a contour of the diaphragm at the vibrating coil in the region of the first and second magnet ring, and wherein a magnetization direction of first and second magnet rings is in the same direction.

9. An electrodynamic sound transducer according to claim 8, wherein the second magnet ring has a cross-section which has a projection which extends towards the vibrating coil coupled to the diaphragm and is adapted to a contour of the diaphragm at the vibrating coil.

* * * * *